United States Patent [19]

Bischoff et al.

[11] Patent Number: 4,471,983

[45] Date of Patent: Sep. 18, 1984

[54] COMPACT ELECTRIC DOOR OPENER

[75] Inventors: Jules P. Bischoff, Englewood Cliffs; Howard P. Munch, Ft. Lee, both of N.J.

[73] Assignee: Square D Company, Palatine, Ill.

[21] Appl. No.: 280,641

[22] Filed: Jul. 6, 1981

[51] Int. Cl.[3] ..... E05C 19/00

[52] U.S. Cl. ..... 292/341.16; 292/DIG. 53

[58] Field of Search ..... 292/341.16, 337, DIG. 53, 292/144

[56] References Cited

U.S. PATENT DOCUMENTS

| | | | |
|---|---|---|---|
| 3,211,850 | 10/1965 | Toepfer | 200/61.64 |
| 3,504,511 | 4/1970 | Allen | 292/201 X |
| 3,749,435 | 7/1973 | Balzano | 292/341.16 |
| 3,819,215 | 6/1974 | Fuss | 292/201 |
| 3,910,617 | 10/1975 | Scalza et al. | 292/341.16 |
| 4,211,443 | 7/1980 | Butts et al. | 292/341.16 |

FOREIGN PATENT DOCUMENTS

| | | | |
|---|---|---|---|
| 145306 | 2/1952 | Australia | 292/201 |

*Primary Examiner*—Richard E. Moore

*Attorney, Agent, or Firm*—Carmen B. Patti; Stephen A. Litchfield

[57] ABSTRACT

This disclosure depicts a novel compact electric door opener for use in a hollow metal door frame having an opening and two tabs adjacent the opening. The electric door opener comprises a housing, a solenoid contained within the housing, a conical spring attached to the solenoid, an armature pivotally attached to the housing and in contact with the conical spring. The armature has a latch engaging surface. A pivotable latch is attached to the housing and a portion of the latch contacts the latch engaging surface of the armature. The latch is restrained from pivoting by the armature except when the solenoid is energized. A temporary means for holding the housing and a means for securing the housing to the tabs of the door frame is also provided. The temporary means for holding the housing is removed after the means for securing has attached the housing to the tabs of the door frame.

11 Claims, 8 Drawing Figures

COMPACT ELECTRIC DOOR OPENER

BACKGROUND OF THE INVENTION AND PRIOR ART STATEMENT

This invention relates in general to electric door openers. Conventionally, electric door openers are of such a large size that extensive reworking of the door frame is necessary for installation. Because it is necessary to modify the door frame for installation, installation becomes an expensive and time consuming operation. Numerous variations of complex mechanisms for electric door openers exist in the prior art and result in expensive manufacturing costs.

Numerous patents exist in the prior art in the field of electric door openers and electric strikes. U.S. Pat. No. 3,211,850 issued to Toepfer, U.S. Pat. No. 3,819,215 issued to Fuss, and U.S. Pat. No. 4,211,443 issued to Butts et al are typical of prior art electric door openers. These patents all cover similar inventions and only U.S. Pat. No. 4,211,443 will be discussed in particular.

The mechanism of the electric door strike disclosed is illustrated in FIG. 1 of U.S. Pat. No. 4,211,443 and consists primarily of a solenoid 66, a locking cam 44; a locking lever 32, and a pivotable keeper 80. The combination of the locking cam and locking lever is typical and is also disclosed in U.S. Pat. Nos. 3,189,215 and 3,211,850. This combination in part results in a necessarily large unit and is expensive to manufacture. This type of electric door opener has seen wide spread use and until the occurrence of the present invention, a small and economical electric door opener having the equivalent or superior operating characteristics of prior art electric door openers has not been in existence.

The relevance of the prior art indicated in the present specification should not be given a limited interpretation. A cited prior art item may be found to have relevance in a passage other than the one referred to, or to have relevance in sense different than as stated.

OBJECTS OF THE INVENTION

It is a general object of the present invention to provide an improved electric door opener.

It is more specific object of this invention to provide an effective and low cost electric door opener of reduced size to eliminate re-working of standard door frames.

It is another object of the present invention to provide an electric door opener which has a simple mechanism and is inexpensive to manufacture.

BRIEF DESCRIPTION OF THE DRAWINGS

Features of the present invention which are believed to be novel are set forth with particularity in the appended claims. The invention together with further objects and advantages may best be understood by reference to the following description taken in conjunction with the accompanying drawings, in the several figures of which like reference numerals identify like elements, and in which:

DESCRIPTION OF THE PREFERRED EMBODIMENT

Figure 1:
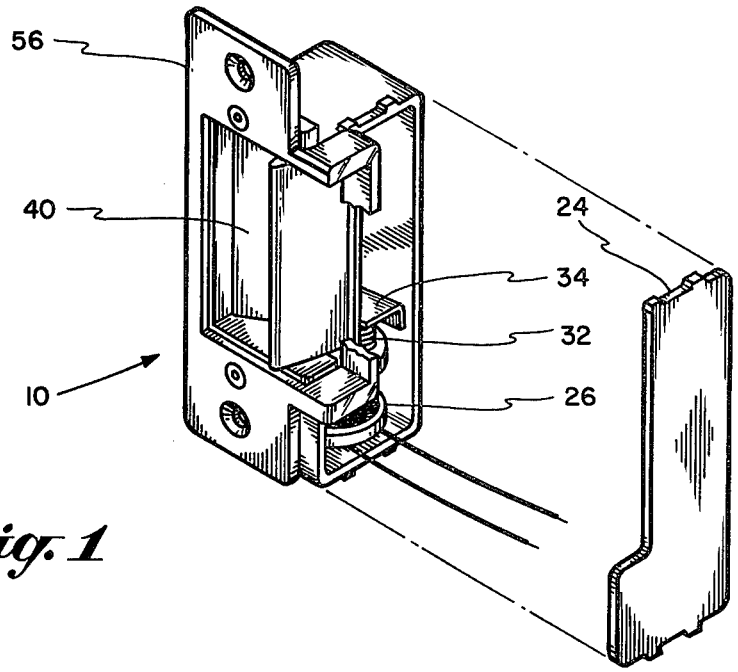
FIG. 1 is a perspective view of the novel electric door opener.

Whereas the invention may be implemented in various types of electric door openers, it is preferably embodied in a design as shown in FIG. 1. The novel electric door opener illustrated in FIG. 1 is sufficiently small so that it may be utilized in a hollow metal door frame without substantial re-working of the frame. The mechanism of the electric door opener is simple and reliable and is inexpensive to manufacture.

The present invention will now be described. In general terms this invention involves a novel electric door opener for use primarily with a hollow metal door frame having an opening and two tabs adjacent the opening. The electric door opener comprises a housing for insertion through the opening in the door frame. The housing has first and second ends, first and second sides and a bottom. A cover is provided for an open side of the housing. A solenoid having first and second ends and contained within the housing is provided. The first end of the solenoid is adjacent the first end of the housing. A conical spring is attached to the second end of the solenoid and extends a predetermined distance beyond the second end. An armature is pivotally attached to the housing and is in contact with the conical spring such that the conical spring pushes the armature away from the solenoid. When the solenoid is energized, the solenoid pulls the armature toward the second end of the solenoid thereby compressing the conical spring. The armature also has a latch engaging surface. A latch is pivotally attached to the housing in the first side of the housing near the second end of the housing. The latch is located perpendicularly with respect to the armature. A portion of the latch contacts the latch engaging surface such that the latch is restrained from pivoting by the armature except when the solenoid is energized. When the solenoid is energized the armature is moved towards the second end of the solenoid thereby allowing the latch to pivot into the housing when an external force is applied to the latch. A temporary means for holding the housing is provided, the means for holding the housing is removably attached to the first side of the housing. A means for securing the housing to the tabs of the door frame is provided and the means for securing the housing has a hole for receiving the temporary means for holding. The temporary means for holding is removed after the means for securing has attached the housing to the tabs of the door frame.

FIGS. 1 through 5 of the drawings illustrate a preferred embodiment of the present invention. The novel compact electric door opener comprises a substantially rectangular housing 10 having first and second ends 12 and 14, first and second sides 16 and 18 and a bottom 20. The housing 10 has an open top 22. A cover 24 can be attached over the open top 22 of the housing to seal the electric door opener. A solenoid 26 has first and second ends 28 and 30 and is contained within the housing 10. The first end 28 of the solenoid 26 is adjacent the first end 12 of the housing 10 and is attached at that location. Various means of attachment may be utilized.

A conical spring 32 is attached to the second end 30 of the solenoid 26 and extends a predetermined distance beyond the second end 30. The conical spring 32 has a property of constant resistance during compression. An armature 34 is pivotally attached to the housing 10 by armature pivot pin 36. The armature 34 is in contact with the conical spring 32 such that the conical spring 32 pushes the armature 34 away from the solenoid 26. When the solenoid 26 is energized, the solenoid 26 pulls the armature 34 toward the second end 30 of the solenoid 26, thereby compressing the conical spring 32. The armature 34 also has a latch engaging surface 38.

A latch 40 is pivotally attached to housing 10 in the first side 16 of the housing 10 near the second end 14 of the housing 10. The latch 40 is held in place by a latch pivot pin 42. The latch 40 is located perpendicularly with respect to the armature 34. A portion 44 of the latch 40 contacts the latch engaging surface 38 of the armature 34. The latch 40 is restrained from pivoting by the armature 34 except when the solenoid 26 is energized and when the armature 34 is moved toward the second end 30 of the solenoid 26. The latch 40 is then allowed to pivot into the housing 10 where an external force is applied to the latch 40. A latch spring 46 is attached to the latched pivot pin 42 and the latch 40. The latch spring 46 holds the latch 40 in a first outward position when no external force is applied to the latch 40.

Figure 2:
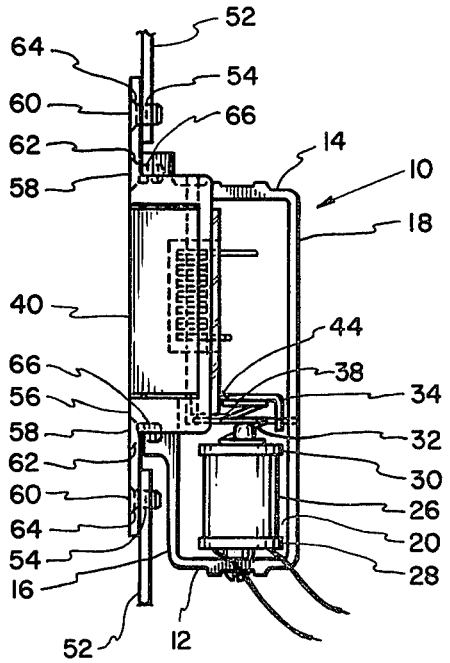
FIG. 2 is a top view of the novel electric door opener showing a latch in an outward position.
Figure 3:
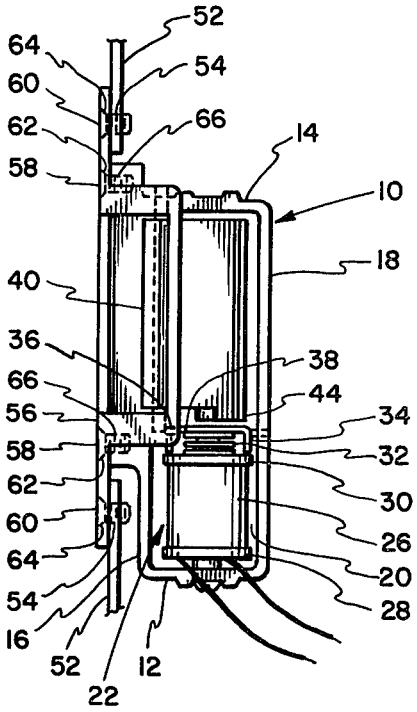
FIG. 3 is a top view showing the latch in an inward position with the solenoid energized.
Figure 4:
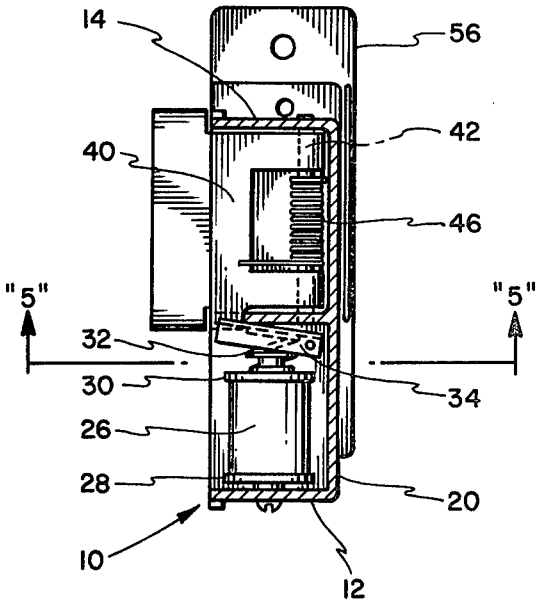
FIG. 4 is a cut away back view of the electric door opener.
Figure 5:
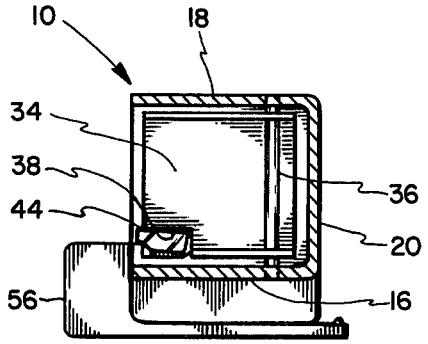
FIG. 5 is a cut away end view of the novel electric door opener.

FIG. 2 shows the latch 40 being held in the first outward position and FIG. 3 shows the latch 40 in a second inward position when an external force is applied to the latch 40 and when the solenoid 26 has been energized. When the solenoid 26 is energized the armature 34 is pulled back toward the second end 30 of the solenoid 26 compressing the conical spring 32. When the external force is removed from the latch 40, the latch spring 46 will return the latch 40 to the first outward position even though the solenoid 26 remains energized.

FIGS. 2 and 3 also illustrate how the housing 10 is attached to a hollow metal door frame. Standard hollow metal door frames conventionally have two tabs 52 with threaded apertures 54 for attachment of various door latch devices. A faceplate 56 is provided which is attached to the housing 10 by screws 58. The faceplate 56 is then attached by screws 60 to the tabs 52. In the alternative, the apertures 54 and the tabs 52 may be non-threaded and screws 60 may be sheet metal screws. The faceplate 56 has at least two apertures 62 in alignment with the screw receiving apertures 54 in the tabs 52 of the door frame. The faceplate 56 also has at least two holes 64 in alignment with threaded holes 66 in the housing 10.

In general terms the method of installing the compact electric door opener in a hollow metal door frame having an opening and two tabs adjacent the opening comprising the steps of: providing an electric door opening means; providing a housing means for containing the electric door opening means, the housing means having at least a front side; inserting the housing means through the opening in the door frame; attaching a temporary means for holding to the housing, the means for holding the housing being attached to the front side of the housing means; securing the housing means to the tabs of the door frame with a faceplate, the faceplate having a hole for receiving the temporary means for holding; and removing the temporary means for holding after the faceplate has attached the housing means to the tabs of the door frame.

Figure 6:
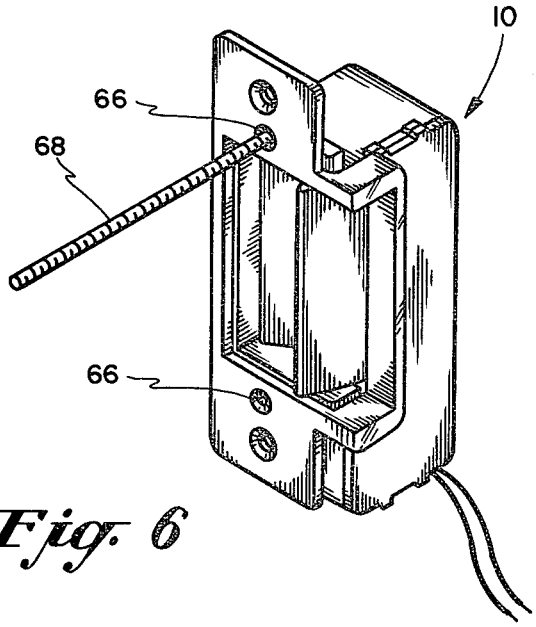
FIGS. 6, 7 and 8 illustrate the steps necessary for installing the electric door opener in a metal door frame.
Figure 7:
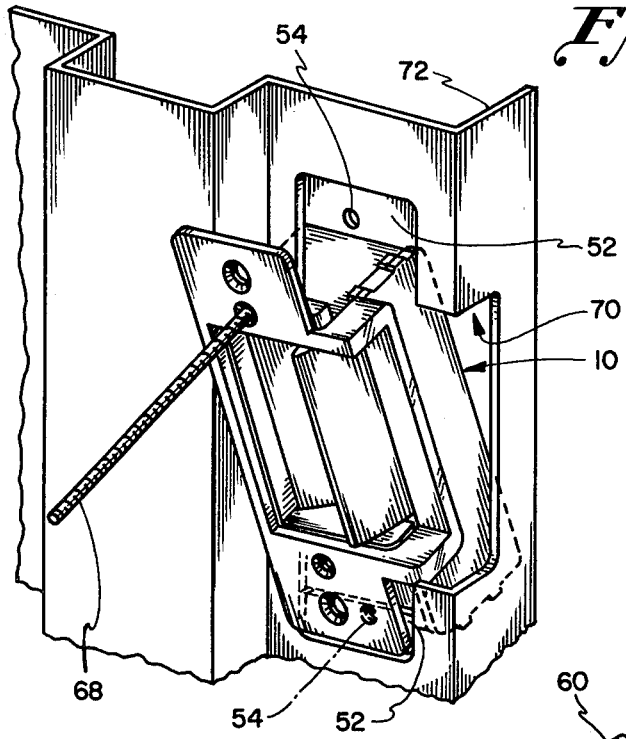
Figure 8:
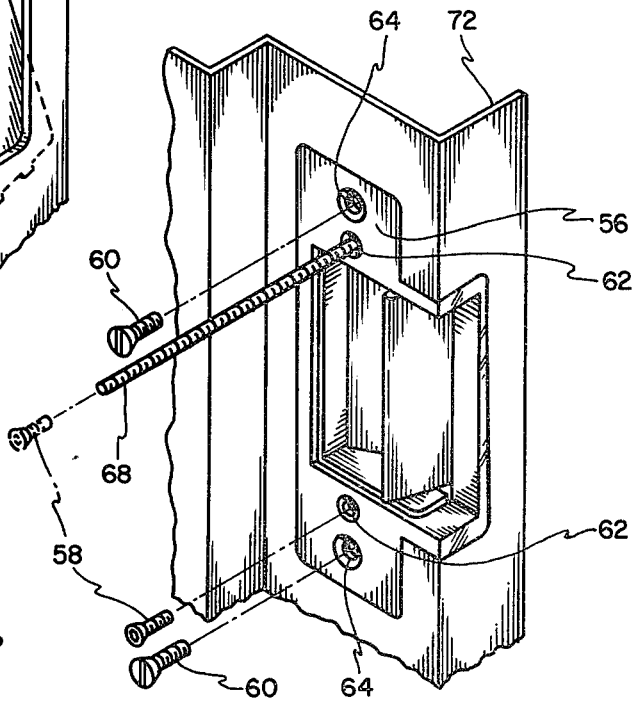

FIGS. 6, 7, and 8 illustrate the method of installing the novel electric door opener in a hollow metal door frame. The solenoid 26, the conical spring 32, the armature 34 and the latch 40 comprise an electric door opening means which is contained in a housing means or housing 10. As shown in FIG. 6 a temporary means for holding the housing means, which is a long threaded rod 68, is inserted into one of the threaded holes 66 of the housing 10. As shown in FIG. 7 the first end 12 of the housing 10 is inserted through an opening 70 in the metal door frame 72. When the housing 10 is totally within the metal door frame 72, the threaded rod 68 provides a means for holding the housing 10 in position and thereby preventing accidental dropping of the housing 10 down the door frame 72.

The threaded rod 68 is then passed through one of the holes 64 in the faceplate 56 which is a means for securing the housing means to the tabs of the door frame. Faceplate 56 is placed adjacent to the housing 10 such that the holes 64 of the faceplate align with the threaded holes 66 of the housing and the apertures 62 of the faceplate 56 aligned with the threaded apertures 54 in the tabs 52 of the metal door frame 70. The screws 60 are then utilized to attach the faceplate 56 to the tabs 52 and one screw of the two screws 58 is utilized to attach the faceplate 56 to the housing 10. The threaded rod 68 is then removed from the threaded hole in the housing 10 and the other screw 58 is inserted into that location to secure the housing 10 to the faceplate 56 thereby completing the attachment of the housing 10 to the metal door frame.

The novel method provides a fast and easy means for installing the electric door opener in hollow metal door frames. This greatly reduces the labor cost which is an important factor in construction projects. Utilizing the long threaded rod 68 prevents accidental dropping of the housing 10 down the metal door frame 72 which in many cases may make it irretrievable.

The invention is not limited to the particular details of the apparatus and method depicted and other modifications and applications are contemplated. Certain other changes may be made in the above described apparatus and method without the departing from the true spirit and scope of the invention herein involved. It is intended, therefore, that the subject matter in the above depiction shall be interpreted as a illustrative and not in a limiting sense.

What is claimed is:

1. A compact electric door opener for use with a hollow metal door frame having an opening and two tabs adjacent the opening, said electric door opener comprising:

a housing for insertion through the opening in the door frame, said housing having first and second ends, first and second sides and a bottom;

a solenoid having first and second ends and contained within said housing, said first end of said solenoid being adjacent said first end of said housing;

a conical spring attached to said second end of said solenoid and extending a predetermined distance beyond said second end of said solenoid;

an armature pivotally attached to said housing and in contact with said conical spring such that said conical spring pushes said armature away from said solenoid and, when said solenoid is energized, said solenoid pulls said armature toward said second end of said solenoid, thereby compressing said conical spring, said armature also having a latch engaging surface, a latch pivotally attached to said housing in said first side of said housing near said second end of said housing and located perpendicularly with respect to said armature, a portion of said latch contacting said latch engaging surface, such that said latch is restrained from pivoting by said armature except when said solenoid is energized and said armature is moved toward said second end of said solenoid, thereby allowing said latch to pivot into said housing;

a temporary means for holding said housing to said frame, said temporary means for holding said housing to said frame being removably attached to said first side of said housing; and a means for securing said housing to the tabs of the door frame and said means for securing said housing having a hole for receiving said temporary means for holding;

wherein said temporary means for holding may be removed after said means for securing has attached said housing to the tabs of the door frame.

2. A compact electric door opener for use with a hollow metal door frame having an opening and two tabs adjacent the openings, said electric door opener comprising:

an electric door opening means;

a housing means for containing said electric door opening means, said housing means being inserted through the opening in the door frame, said housing means having at least a first side;

a temporary means for holding said housing means to said frame, said means for holding said housing means to said frame being removably attached to said first side of said housing means; and a means for securing said housing means to the tabs of the door frame and said means for securing said housing means having a hole for receiving said temporary means for holding;

wherein said temporary means for holding may be removed after said means for securing has secured said housing means to the tabs of the door frame.

3. The device described in claim 2 wherein said housing means comprises a substantially rectangular housing having first and second ends, first and second sides and a bottom, said housing means also comprising a cover for attaching to said first and second ends of said housing.

4. The device described in claim 2 wherein said temporary means for holding comprises a long threaded rod and wherein said housing means has a threaded aperture for receiving said threaded rod.

5. The device described in claim 2 wherein each of the tabs of the door frame has a screw receiving aperture and wherein said means for securing said housing means to the tabs of the door frame comprises a face plate having at least two apertures in alignment with the screw receiving apertures in the tabs of the door frame and two screws for securing the face plate to the tabs, said face plate also having at least two holes one of which is in alignment with a threaded hole in said front side of said housing for receiving a screw thereby attaching the face plate to the housing.

6. A compact electric door opener for use with a hollow metal door frame having a substantially rectangular opening and two tabs with screw receiving apertures, said electric door opener comprising:

an electric door opening means;

a substantially rectangular housing for receiving said electric door opening means, said rectangular housing able to be inserted through the opening in the door frame and having first and second ends, first and second sides and a bottom;

a cover for attachment to said housing;

a long threaded rod for holding said housing to said door frame, said threaded rod being received in a threaded aperture in said housing; and a face plate having at least two apertures in alignment with the screw receiving apertures in the tabs of the door frame and two screws for securing said faceplate to the tabs and said faceplate also having at least two holes one of which is in alignment with a threaded hole in the housing for receiving a screw thereby attaching the faceplate to the housing and;

wherein said threaded rod may be removed after said faceplate has been attached with said housing to the tabs of the door frame.

7. A method of installing a compact electric door opener in a hollow metal door frame having an opening and two tabs adjacent the opening, said method comprising;

providing an electric door opening means;

providing a housing means for containing said electric door opening means, said housing means having at least a front side;

inserting said housing means through the opening in the door frame;

attaching a temporary means for holding said housing to said frame, said means for holding said housing being attached to said front side of said housing means; and securing said housing means to the tabs of the door frame with a faceplate, said faceplate having a hole for receiving said temporary means for holding;

removing said temporary means for holding after said faceplate has been attached with said housing means to the tabs of the door frame.

8. A compact electric door opener for use with a hollow metal door frame having an opening and two tabs adjacent the opening, said electric door comprising:

a substantially rectangular housing for insertion through the opening in the door frame, said housing having first and second ends, first and second sides and a bottom, said housing thereby having an open top;

a cover for attaching to said housing over said open top;

a solenoid having first and second ends and contained within said housing, said first end of said solenoid being adjacent said first end of said housing;

a conical spring attached to said second end of said solenoid and extending a predetermined distance beyond said second end of said solenoid, said conical spring having a property of constant resistance during compression;

an armature pivotally attached to said housing by an armature pivot pin and in contact with said conical spring such that said conical spring pushes said armature away from said solenoid and, when said solenoid is energized, said solenoid pulls said armature toward said second end of said solenoid, thereby compressing said conical spring, said armature also having a latch engaging surface;

a latch pivotally attached to said housing in said first side of said housing near said second end of said housing by a latch pivot pin and located perpendicularly with respect to said armature, a portion of said latch contacting said latch engaging surface, such that said latch is restrained from pivoting by said armature and held in a first outward position except when said solenoid is energized and said armature is moved toward said second end of said solenoid, thereby allowing said latch to pivot into said housing to a second inward position;

a latch spring attached to said latch and said latch pivot pin for holding said latch in said first outward position when no external force is applied to said latch;

a long threaded rod for holding said housing to said metal door frame, said threaded rod being received in a threaded aperture in said housing;

a face plate having at least two apertures in alignment with the screw receiving apertures in the tabs of the door frame and two screws for securing said faceplate to the tabs, said faceplate also having at least two holes one of which is in alignment with a threaded hole in the housing for receiving a screw thereby attaching the faceplate to the housing;

wherein said threaded rod may be removed after said faceplate has attached said housing to the tabs of the door frame.

9. A compact electric door opener comprising:

a housing having at least first and second ends;

a solenoid having first and second ends and contained within said housing, said first end of said solenoid being adjacent said first end of said housing;

a conical spring attached to said second end of said solenoid and extending a predetermined distance beyond said second end of said solenoid; said conical spring having a property of substantially constant resistance during compression;

an armature pivotally attached to said housing and in contact with said conical spring such that said conical spring pushes said armature away from said solenoid and, when said solenoid is energized, said solenoid pulls said armature toward said second end of said solenoid, thereby compressing said conical spring, said armature also having a latch engaging surface; and a latch pivotally attached to said housing near said second end of said housing and located substantially perpendicular to said armature, a portion of said latch contacting said latch engaging surface, said latch pivotable about an axis substantially parallel to the direction of the action of the solenoid on the armature, such that said latch is restrained from pivoting by said armature except when said solenoid is energized and said armature is moved toward said second end of said solenoid, thereby allowing said latch to pivot into said housing.

10. The device described in claim 9 wherein said latch has a latch pivot pin and a latch spring whereby said latch spring holds said latch in a first outward position and when said armature is moved toward said second end of said solenoid and an external force is applied to said latch, said latch is pivoted into said housing to a second inward position, said latch spring causing said latch to return to said first position when said external force is removed.

11. The device described in claim 9 wherein said armature has an armature pivot pin.

* * * * *